US009523257B2

(12) United States Patent
Hallundbæk et al.

(10) Patent No.: US 9,523,257 B2
(45) Date of Patent: Dec. 20, 2016

(54) DOWNHOLE TUBULAR SYSTEM AND ASSEMBLY FOR SEALING AN OPENING

(71) Applicant: WELLTEC A/S, Allerød (DK)

(72) Inventors: Jørgen Hallundbæk, Græsted (DK); Tomas Sune Andersen, Helsingør (DK)

(73) Assignee: WELLTEC A/S, Allerød (DK)

( * ) Notice: Subject to any disclaimer, the term of this patent is extended or adjusted under 35 U.S.C. 154(b) by 422 days.

(21) Appl. No.: 14/363,872

(22) PCT Filed: Dec. 21, 2012

(86) PCT No.: PCT/EP2012/076540
§ 371 (c)(1),
(2) Date: Jun. 9, 2014

(87) PCT Pub. No.: WO2013/092944
PCT Pub. Date: Jun. 27, 2013

(65) Prior Publication Data

US 2014/0367123 A1 Dec. 18, 2014

(30) Foreign Application Priority Data

Dec. 23, 2011 (EP) ..... 11195620

(51) Int. Cl.
*E21B 33/10* (2006.01)
*E21B 33/13* (2006.01)
*E21B 43/10* (2006.01)

(52) U.S. Cl.
CPC ..... *E21B 33/13* (2013.01); *E21B 33/10* (2013.01); *E21B 43/105* (2013.01)

(58) Field of Classification Search
CPC ..... E21B 33/13; E21B 33/10; E21B 43/105
See application file for complete search history.

(56) References Cited

U.S. PATENT DOCUMENTS 3,270,817 A 9/1966 Papaila
4,515,213 A 5/1985 Rogen et al.
(Continued)

FOREIGN PATENT DOCUMENTS

CN 201695966 U 1/2011
EP 0 159 300 10/1985
EP 1 719 873 11/2006

OTHER PUBLICATIONS

International Search Report for PCT/EP2012/076540 mailed Feb. 5, 2013.

(Continued)

*Primary Examiner* — William P Neuder
*Assistant Examiner* — Ronald Runyan
(74) *Attorney, Agent, or Firm* — Nixon & Vanderhye P.C.

(57) ABSTRACT

The present invention relates to a downhole system (100) for sealing an opening (2) in a wall of a well tubular structure in a borehole (4) downhole by means of a downhole tubular assembly (1), comprising the downhole tubular assembly comprising an expandable tubular part (5) having an inner face (6) and an unexpanded expandable tubular thickness in an unexpanded state, and a helical spring (7) having a helical inner diameter, a radial helical spring thickness and a helical outer diameter in an unexpanded state, the helical spring being arranged inside the expandable tubular part and substantially concentrically with the expandable tubular part, an expansion tool (9) for expanding the tubular assembly inside the well tubular structure (3) in one direction, the expansion tool comprising an expansion part having a diameter, and the expansion tool being arranged substantially on an axis which is concentric and longitudinal with the tubular assembly, and positioned in a first position, wherein the expandable tubular part is expanded by moving the expansion tool from the first position through the expandable tubular part and the helical spring so that the helical spring extends the diameter of the (Continued)

expansion part and acts as a distance element when expanding the expandable tubular part to abut the well tubular structure for sealing the opening. Furthermore, the present invention relates to a downhole tubular assembly and a method of sealing an opening in a wall of a well tubular structure in a borehole downhole.

20 Claims, 10 Drawing Sheets

(56) References Cited

U.S. PATENT DOCUMENTS

| | | | |
|---|---|---|---|
| 6,068,250 | A | 5/2000 | Hawkins et al. |
| 2004/0020660 | A1 | 2/2004 | Johnson et al. |

OTHER PUBLICATIONS

International Preliminary Report on Patentability for PCT/EP2012/076540 mailed Feb. 10, 2014.
Chinese Office Action mailed Mar. 28, 2016 in Chinese Application No. 201280059924.8, with English Translation (10 pages).

DOWNHOLE TUBULAR SYSTEM AND ASSEMBLY FOR SEALING AN OPENING

This application is the U.S. national phase of International Application No. PCT/EP2012/076540 filed 21 Dec. 2012 which designated the U.S. and claims priority to EP Patent Application No. 11195620.7 filed 23 Dec. 2011, the entire contents of each of which are hereby incorporated by reference.

Field Of The Invention

The present invention relates to a downhole system for sealing an opening in a wall of a well tubular structure in a borehole downhole by means of a downhole tubular assembly. Furthermore, the present invention relates to a downhole tubular assembly and a method of sealing an opening in a wall of a well tubular structure in a borehole downhole.

Background Art

In wellbores, patches or straddles are used for different purposes, such as for sealing a leak or a crack in a casing or for strengthening the well tubular structure, or for shutting off to prevent unwanted inflow of fluids such as water or gas from perforations in the casing. Patches are placed opposite the leak and expanded by means for expansion to abut the inside wall of the casing and thereby seal the leak. In order to arrange the patch opposite e.g. the leak, the patches have to pass through restricted diameters within the wellbore or borehole casing, such as a nipple or a previously set patch.

The patches are often expanded by means of a cone having a fixed diameter. When using such fixed cone, the diameter of the cone is governed by the restrictions of the nipple through which the patch must pass prior to expansion and by the inner diameter of the patch once it has been expanded. The inner diameter of the patch after expansion is approximately the size of the wellbore tubular inner diameter minus twice the wall thickness of the patch, which often leaves very little tolerance when the patch is to pass the restrictions. To avoid the risk of a patch not being able to pass a restriction, known cones have been made expandable. However, this increases the complexity of the tool and thus the costs as well as the risk of tool failure.

SUMMARY OF THE INVENTION

It is an object of the present invention to wholly or partly overcome the above disadvantages and drawbacks of the prior art. More specifically, it is an object to provide an improved downhole tubular assembly where the detachment from the tubular assembly after expansion is facilitated without compromising the ease by which the means for expansion may be carried through narrow parts of a well.

Moreover it is an object of the present invention to provide an improved downhole system for sealing off an opening in a well tubular structure by means of the tubular assembly.

The above objects, together with numerous other objects, advantages, and features, which will become evident from the below description, are accomplished by a solution in accordance with the present invention by a downhole system for sealing an opening in a wall of a well tubular structure in a borehole downhole by means of a downhole tubular assembly, comprising:

the downhole tubular assembly comprising:

an expandable tubular part having an inner face and an unexpanded expandable tubular thickness in an unexpanded state, and a helical spring having a helical inner diameter, a radial helical spring thickness and a helical outer diameter in an unexpanded state, the helical spring being arranged inside the expandable tubular part and substantially concentrically with the expandable tubular part, an expansion tool for expanding the tubular assembly inside the well tubular structure in one direction, the expansion tool comprising an expansion part having a diameter, and the expansion tool being arranged substantially on an axis which is concentric and longitudinal with the tubular assembly, and positioned in a first position, wherein the expandable tubular part is expanded by moving the expansion tool from the first position through the expandable tubular part and the helical spring so that the helical spring extends the diameter of the expansion part and acts as a distance element when expanding the expandable tubular part to abut the well tubular structure for sealing the opening.

By having a helical spring, it is possible to expand the expandable tubular part in order to patch an opening by moving the expansion tool through the helical spring and the expandable tubular part. By doing so, the helical spring acts as a distance element and extends the radial diameter of the expansion tool, allowing for the expandable tubular part to be expanded beyond the diameter of the expansion tool. The expansion tool may then have a fixed cone without limiting the tolerance when the expansion tool is to pass the restrictions within the well tubular structure.

In one embodiment, the expansion tool may comprise a shaft connected with a tapered part of the expansion part.

In another embodiment, the helical spring may be attached, in one end, to the expansion tool.

By using a helical spring and an expandable tubular part, it is possible to make the assembly small and allow it to slide through narrow sections in the well tubular structure. Furthermore, it is possible to reuse the helical spring after sealing the opening with the expandable tubular part by allowing the helical spring to transform back to its original state and inserting the helical spring into a new expandable tubular part. This may be performed downhole by the downhole system.

Furthermore, the tubular assembly of the downhole system may be arranged between the expansion part and a back stop, the back stop having a recess corresponding to that of the tapered part of the expansion part so as to receive the expansion part.

Moreover, the expansion tool may further comprise a helical spring retraction part, the helical spring retraction part being slidable in relation to the expansion part to move the helical spring in a direction opposite the direction of the expansion.

In addition, the well tubular structure may have an outer diameter which is substantially unchanged after expansion of the tubular assembly.

Also, the helical spring may comprise a surface layer that provides low friction when slided against a surface of an inner wall of the expandable tubular part, a surface of the expansion part, and when slided against the surface of the helical spring itself.

In the downhole system as described above, the tubular assembly may comprise a plurality of helical springs, and the helical springs may be arranged inside the expandable tubular part and substantially concentrically with the expandable tubular part, allowing for expansion of the expandable tubular part to abut the well tubular structure.

The present invention further relates to a downhole tubular assembly for sealing an opening in a wall of a well tubular structure in a borehole downhole by means of the downhole system according to the invention, comprising:

an expandable tubular part having an inner face and an unexpanded expandable tubular thickness in an unexpanded state, and a helical spring having a helical inner diameter, a radial helical spring thickness and a helical outer diameter in an unexpanded state, wherein the helical spring is arranged inside the expandable tubular part and substantially concentrically with the expandable tubular part allowing for expansion of the expandable tubular part to abut the well tubular structure by the helical spring acting as a distance element, as the expansion part of the downhole system is moving through the expandable tubular part.

In one embodiment, the inner face of the expandable tubular part may be in contact with the helical spring in an unexpanded state.

In another embodiment, the inner face of the expandable tubular part may be out of contact with the helical spring in an unexpanded state.

In yet embodiment, the helical spring may be wound of a strand having a circular cross-sectional shape, a quadratic cross-sectional shape or an octagonal cross-sectional shape. A circular cross-sectional shape may allow the strand to glide more easily over the expansion tool edges without getting stuck. A circular cross-sectional shape may further allow for the helical spring to twist more easily.

Also, the helical spring may be wound of a strand having a substantially quadratic cross-sectional shape, rectangular cross-sectional shape, hexagonal cross-sectional shape, octagonal cross-sectional shape, or similar polygonal cross-sectional shape.

A cross-sectional shape of the strand having such flat surface provides larger contact points between the strands and the tubular part than when having a circular cross-section and between windings when compressed, thus exerting a large uniform pressure internally in the helical spring and outwards to the expandable tubular part.

An octagonal shape provides a combination of advantages from the circular and the quadratic cross-sectional shapes, i.e. that the strands have a larger contact surface than the circular strands, providing a better transmission of force between the strands when being compressed and also to the expandable tubular part during expansion. By being more circular than the quadratic shape, the strands with the octagonal shape have the ability to glide more easily over edges and rough parts when compressed compared to strands having the quadratic shape.

In addition, the helical spring may be wound of a strand having rounded corners or edges in cross-section. By rounding the edges, the strand will glide more easily over edges on the expansion part of the expansion tool.

In one embodiment, the helical spring may be made of a material having a higher yield strength than that of the expandable tubular part and/or of materials with good spring effect or non-adhesive effects on the expandable tubular part.

In another embodiment, the helical spring may be made of metal, such as carbon steels, alloy steels, corrosion resisting steels, phosphor bronze, spring brass, beryllium copper, nickel alloy steels, titanium alloy steels, music wire, non-ferrous alloy wire, high temperature alloy wire, or any combination thereof.

Further, the helical spring may comprise a surface layer that provides low friction when slided against a surface of the inner wall of the expandable tubular part, a surface of the expansion part of the downhole system, and when slided against the surface of the helical spring itself.

Also, the surface layer may comprise a carbon-containing steel, a Teflon coating layer (i.e. polytetrafluoroetylene (PTFE)), an Aluminium magnesium boride layer (BAM), a titanium layer, a stainless steel layer or a steel layer.

By having a plurality of springs, it is possible to combine favourable properties from e.g. different materials and different cross-sectional shapes.

Moreover, the tubular assembly may comprise a plurality of helical springs, wherein the helical springs may be arranged inside the expandable tubular part and substantially concentrically with the expandable tubular part, allowing for expansion of the expandable tubular part to abut the well tubular structure.

In one embodiment, the plurality of helical springs may be arranged in series.

In another embodiment, the plurality of helical springs may be connected in a serial connection.

In a third embodiment, the plurality of helical springs may be connected in a mesh.

Furthermore, the helical spring may be attached, in one end, to the expandable tubular part.

By attaching the helical spring to the expansion tool, the helical spring may be reused, and it may be ensured that no retraction happens from one end due to coiling up of the helical spring during expansion.

Moreover, the expansion tool may further comprise a helical spring retraction part, the helical spring retraction part being slidable in relation to the expansion part to move the helical spring in a direction opposite the direction of the expansion.

Furthermore, the tubular assembly may be arranged between the expansion part and a back stop, the back stop having a recess corresponding to that of the tapered part of the expansion part so as to receive the expansion part.

In addition, the well tubular structure may have an outer diameter which is substantially unchanged after expansion of the tubular assembly.

Further, the well tubular structure may have an inner diameter and the inner diameter may be substantially unchanged after expansion of the tubular assembly.

The present invention finally relates also to a method for sealing an opening in a wall of a well tubular structure in a borehole downhole, comprising the steps of:

determining a position in order to seal the opening, cover a leakage or a perforated zone or strengthen the wall of the well tubular structure, arranging a downhole tubular assembly opposite the position for setting an expandable tubular part of the tubular assembly, expanding the tubular assembly until the expandable tubular part abuts the inner surface of the well tubular structure by moving an expansion tool of the downhole system through the inside of the tubular assembly, unwinding the helical spring, and letting the helical spring return, at least partly, to a relaxed condition of the helical spring, thereby removing the helical spring from the expandable tubular part when the expandable tubular part has been expanded in its entire length and seals off the opening.

The method may further comprise the step of moving the helical spring out of contact with the expansion part by means of the helical spring retraction part.

Also, the method as described above may further comprise the step of arranging a second expandable tubular part around the helical spring, thereby reusing the helical spring.

In said method, the expanding step may be performed by arranging the expansion part having an outer diameter which is smaller than the helical inner diameter inside the tubular assembly, and subsequently expanding the expansion part radially.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
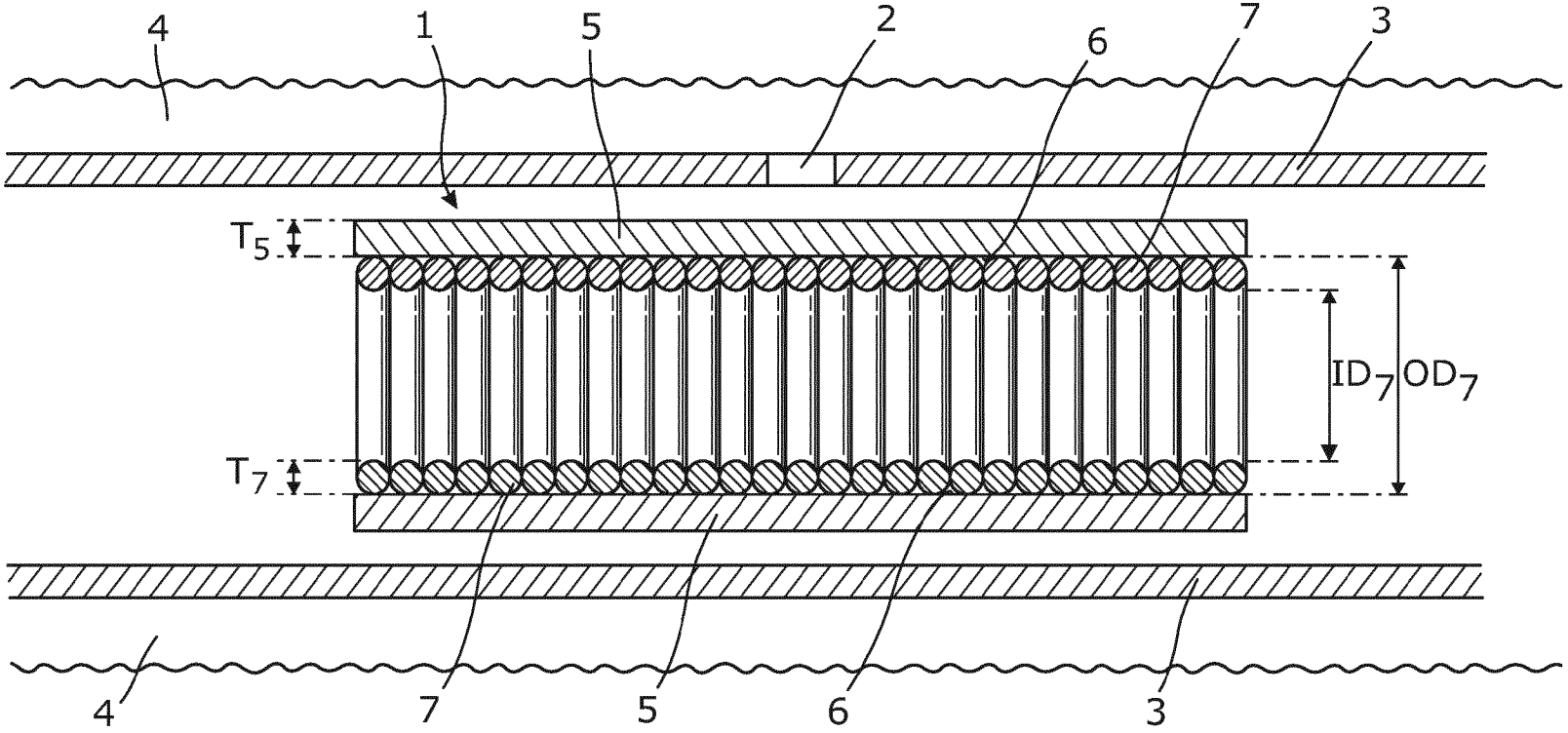
FIG. 1 is a cross-sectional view of a downhole tubular assembly in a well tubular structure.

FIG. 1 shows a downhole tubular assembly 1 in an unexpanded state for sealing an opening 2 in a well tubular structure 3 in a borehole 4 downhole. The tubular assembly 1 comprises an expandable tubular part 5 having an inner face 6 and an unexpanded expandable tubular thickness T5 and a helical spring 7 having a radial helical spring thickness T7, a helical inner diameter ID7 and a helical outer diameter OD7 in the unexpanded condition as shown in FIG. 1. The helical spring 7 is arranged inside the expandable tubular part 5 and is substantially concentrical with the expandable tubular part 5. In this embodiment, the outer diameter OD7 of the helical spring 7 is substantially equal to an inner diameter of the expandable tubular part 5 so that the helical spring 7 is abutting the expandable tubular part 5.

By using the helical spring 7 and the expandable tubular part 5, it is possible to make the tubular assembly 1 and the expansion tool (not shown in FIG. 1) relatively small in diameter to allow the tubular assembly 1 to slide through narrow sections in the well tubular structure 3 and still be able to expand to larger diameters of the well tubular structure 3 in order to seal the opening 2. Furthermore, it is possible to reuse the helical spring 7 after sealing the opening 2 with the expandable tubular part 5 by allowing the helical spring 7 to retract to its unexpanded state.

The downhole tubular assembly 1 may also be used for sealing other structural openings 2 in the well tubular structure 3, e.g. cracks, holes, perforations or other types of structural openings, or used for strengthening weak parts of the well tubular structure.

The expandable tubular part 5 may be made of materials appropriate for sealing the opening 2 by expansion of the expandable tubular part 5, such as alloys, intermetallics, composites, expandable ceramics, elastomers, rubbers, polymers, or a combination thereof.

The length of the expandable tubular part 5 in a longitudinal direction is, preferably, at least long enough to cover the structural opening 2 in a longitudinal direction of the well tubular structure 3. In the event that a perforation zone has to be sealed, a plurality of expandable tubular parts 5 may be patched in series so that the plurality of expandable tubular parts 5 combined are long enough to cover the perforations in a longitudinal direction of the well tubular structure 3.

Figure 2C:
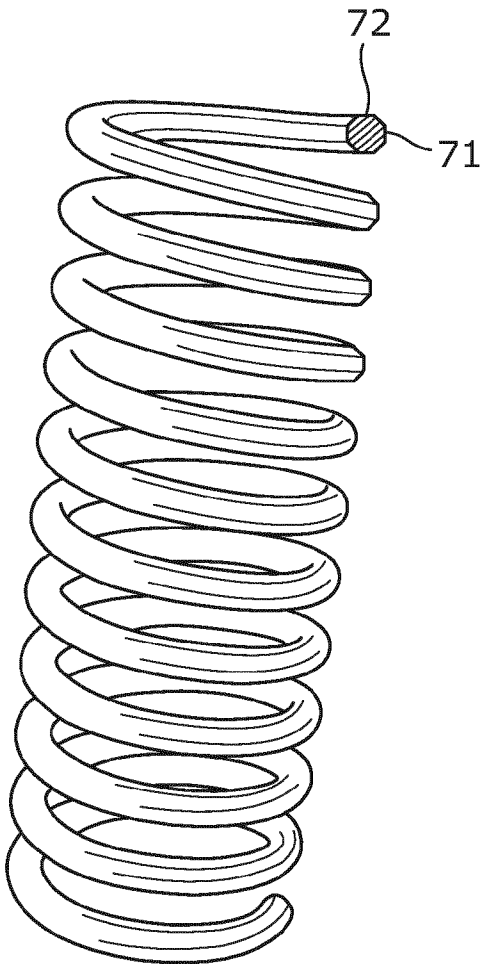
FIGS. 2A-C show a helical spring with different cross-sectional shapes.
Figure 2B:
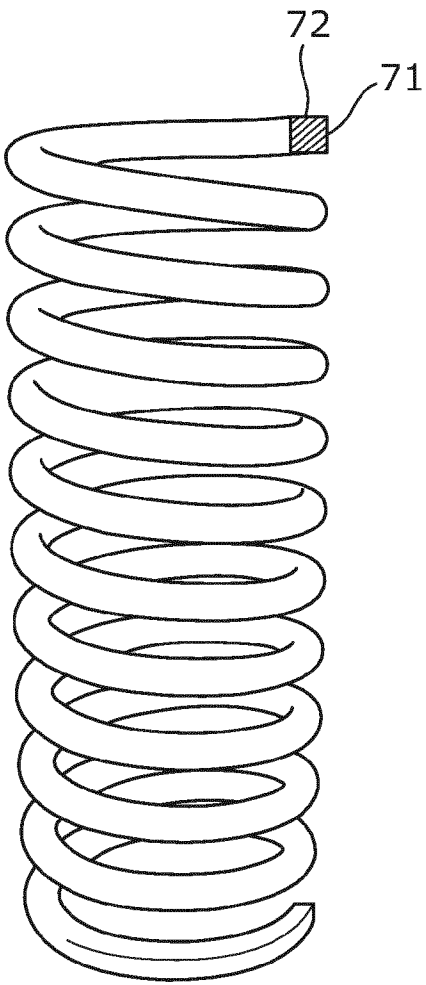
Figure 2A:
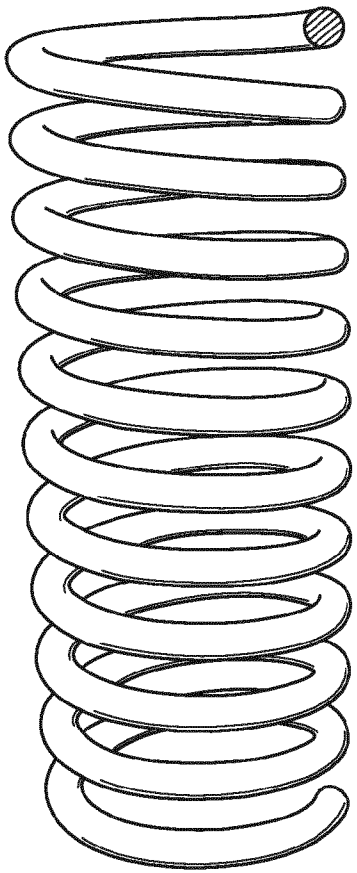

The helical spring 7 is made by winding a strand or a wire as shown in FIGS. 2A-2C. The strand or wire may have a circular cross-sectional shape as shown in FIG. 2A. By having a circular cross-sectional shape, the helical spring 7 may more easily slide and twist on the inner face 6 of the expandable tubular part 5 with low friction towards edges, bumps etc.

As shown in FIG. 2B, the helical spring 7 may be made by winding a strand or wire having a quadratic cross-sectional shape. The quadratic cross-sectional shape increases a radial contact surface 71 towards the inner surface 6 of the expandable tubular part 5, and a longitudinal contact surface 72 between neighbouring windings of the helical spring 7 when being compressed is larger than that of a helical spring having a circular cross-sectional shape, thereby allowing the helical spring 7 with a quadratic cross-sectional shape to exert a higher pressure in the longitudinal direction without being deformed.

In FIG. 2C, the helical spring 7 is wound of a strand having an octagonal cross-sectional shape. An octagonal cross-sectional shape provides a combination of advantages from the circular and quadratic cross-sectional shapes, having large radial and longitudinal contact surfaces 71, 72 similar to those of the quadratic shape, but a strand with an octagonal shape still has the ability of gliding relatively easy over edges and irregularities during expansion.

Figure 3A:
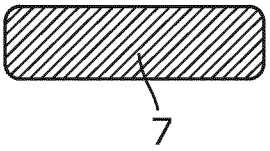
FIGS. 3A-C show cross-sectional shapes of a helical spring with rounded corners.
Figure 3B:
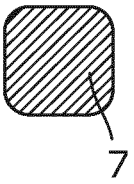
Figure 3C:
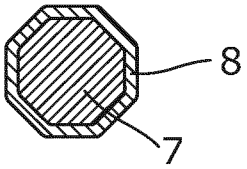

As shown in FIGS. 3A-C, the helical spring 7 having a rectangular, a quadratic and an octagonal cross-sectional shape, respectively, has rounded corners. Rounded corners enhance the ability of the helical spring 7 to slide in relation to the expansion tool. Furthermore, as shown in FIG. 3C, the helical spring 7 also comprises a surface layer 8 for reducing the friction during expansion of the expandable tubular part 5. The surface layer 8 may comprise a carbon-containing steel, a Teflon coating layer, an Aluminium magnesium boride (BAM) layer, a titanium layer, a stainless steel layer, a steel layer or other type of known coating layers to reduce friction between the surfaces of the helical spring 7, expansion tool and the expandable tubular part.

Figure 4:
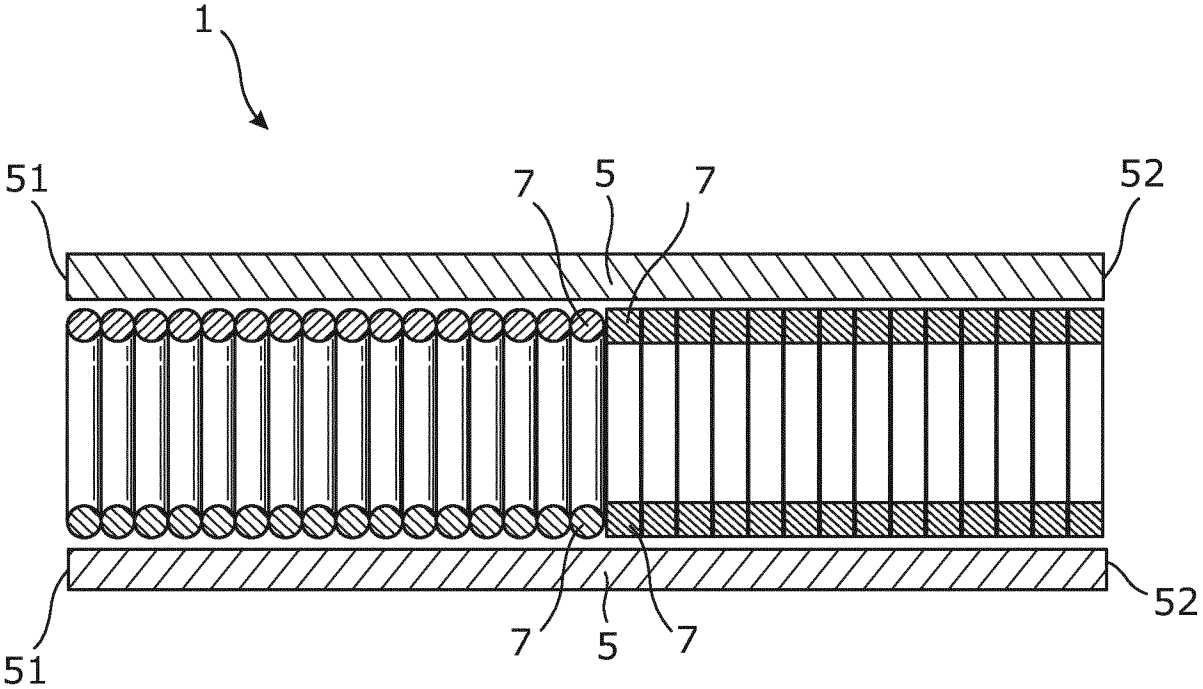
FIG. 4 is a cross-sectional view of a tubular assembly comprising a plurality of helical springs with different cross-sectional shapes.

As shown in FIG. 4, the tubular assembly 1 may comprise a plurality of helical springs 7 arranged between a first end 51 and a second end 52 inside the expandable tubular part 5 instead of one helical spring. The plurality of helical springs 7 may have different cross-sectional shapes, may be made of different materials, and have different diameters etc. A plurality of different helical springs 7 makes it possible for example to combine favourable properties of different materials, such as low friction, temperature resistant springs, high spring constants, different cross-sectional shapes of the helical spring 7 etc. in order to combine appropriate properties of different helical springs in the same expansion procedure of the expandable tubular part 5. However, even providing a plurality of helical springs 7 inside the expandable tubular part 5 having the same shape and material may be beneficial since each helical spring 7 is more freely expanded and contracted due to each helical spring 7 being less limited in the longitudinal direction due to the shorter length of each helical spring 7. Thereby, expansion in the radial direction is not hindered, as could be the case for middle sections of a long helical spring 7.

Figure 5:
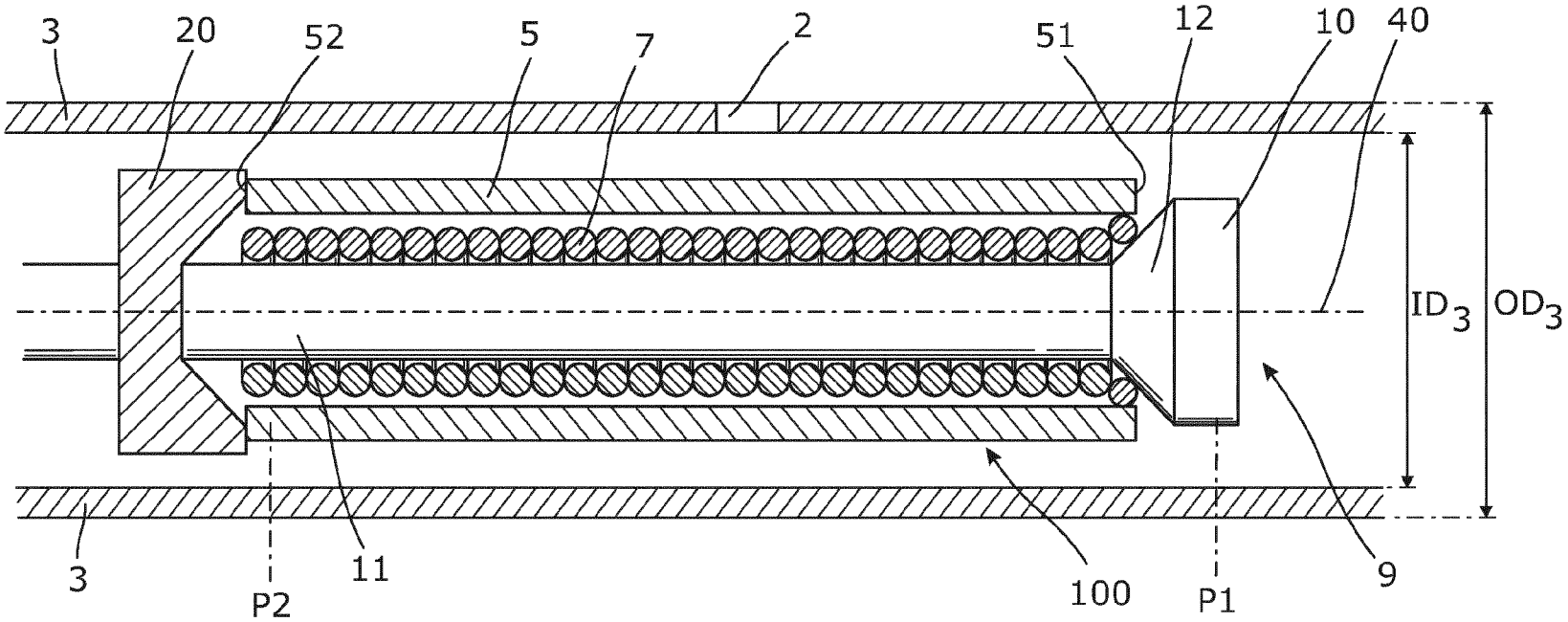
FIG. 5 is a cross-sectional view of a downhole system comprising a tubular assembly and an expansion tool before expansion.

In FIG. 5, a downhole system 100 is shown. The downhole system comprises an expansion tool 9 for expanding the tubular assembly 1 inside the well tubular structure 3. The expansion tool 9 has an expansion part 10 comprising a tapered part 12, and the expansion tool 9 is arranged substantially concentrically with the tubular assembly 1 on a longitudinal axis 40 and positioned in a first position P1 before expansion. The expandable tubular part 5 is expanded by moving the expansion tool 9 through the expandable tubular part 5 and the helical spring 7.

The force from the expansion part 10 is transferred to the expandable tubular part 5 through the helical spring 7, allowing the expandable tubular part 5 to patch the structural opening 2. When the expansion tool 9 is moved through the expandable tubular part 5, the helical spring 7 extends the diameter of the expansion part 10 and acts as a distance element when expanding the expandable tubular part 5 to abut the well tubular structure 3, thereby sealing the opening 2.

Figure 6:
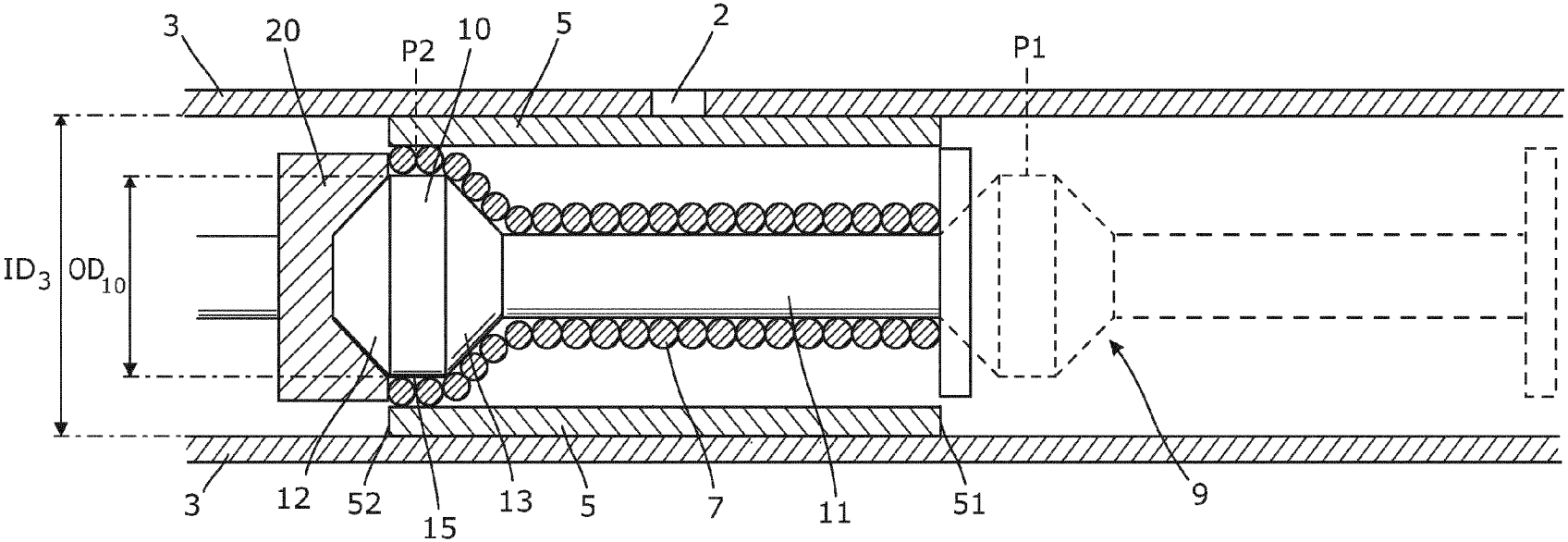
FIG. 6 is a cross-sectional view of another downhole system after expansion.
Figure 7:
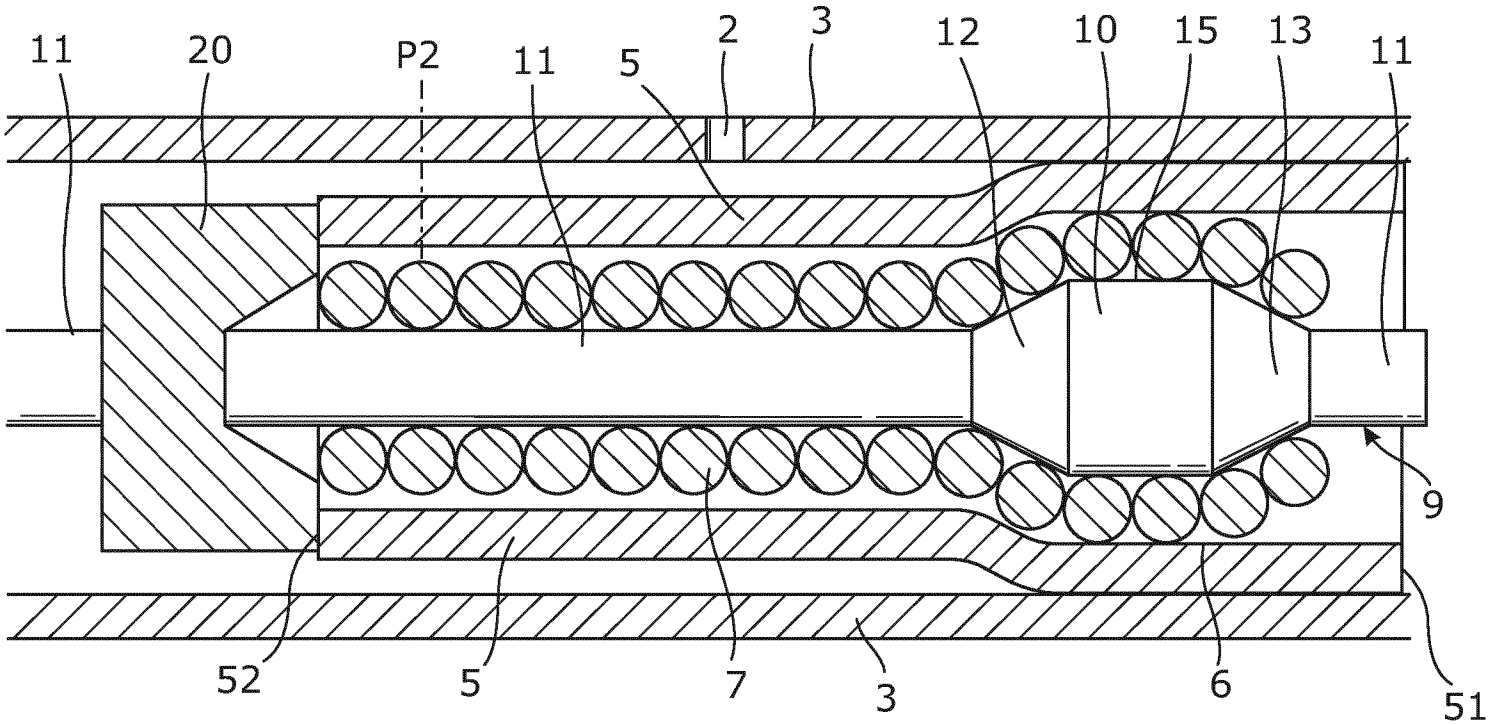
FIG. 7 is a cross-sectional view of yet another downhole system during expansion.

As shown in FIGS. 5-7, the expansion tool 9 may expand the tubular assembly 1 by forcing the expansion part 10 having a fixed outer diameter OD10 which is larger than the inner diameter ID7 of the helical spring 7 through the expandable tubular part 5 and the helical spring 7. An initial stage of an expansion of the tubular assembly 1 is seen in FIG. 5 in which the expansion part 10 is in the first position P1 at a first end 51 of the tubular part 5. In FIG. 6 showing another expansion tool 9, the expansion part 10 is located in a second position P2 at a second end 52 of the expandable tubular part 5 after expansion, and in FIG. 7 showing yet another expansion tool 9, the expansion part 10 is in an intermediate position between the first position P1 and the second position P2, in which position the expandable tubular part 5 is partly expanded.

The patching of the opening 2 may alternatively (not shown) be performed by expanding the expandable tubular part 5 and the well tubular structure 3 so that an inner diameter ID5 of the expandable tubular part 5 is equal to or larger than the inner diameter ID3 of the well tubular structure 3 after expansion.

The movement from the first position P1 to the second position P2 may be performed by moving a shaft 11 connected with the expansion part 10 towards a back stop 20, as seen in FIGS. 5-7.

Figure 8:
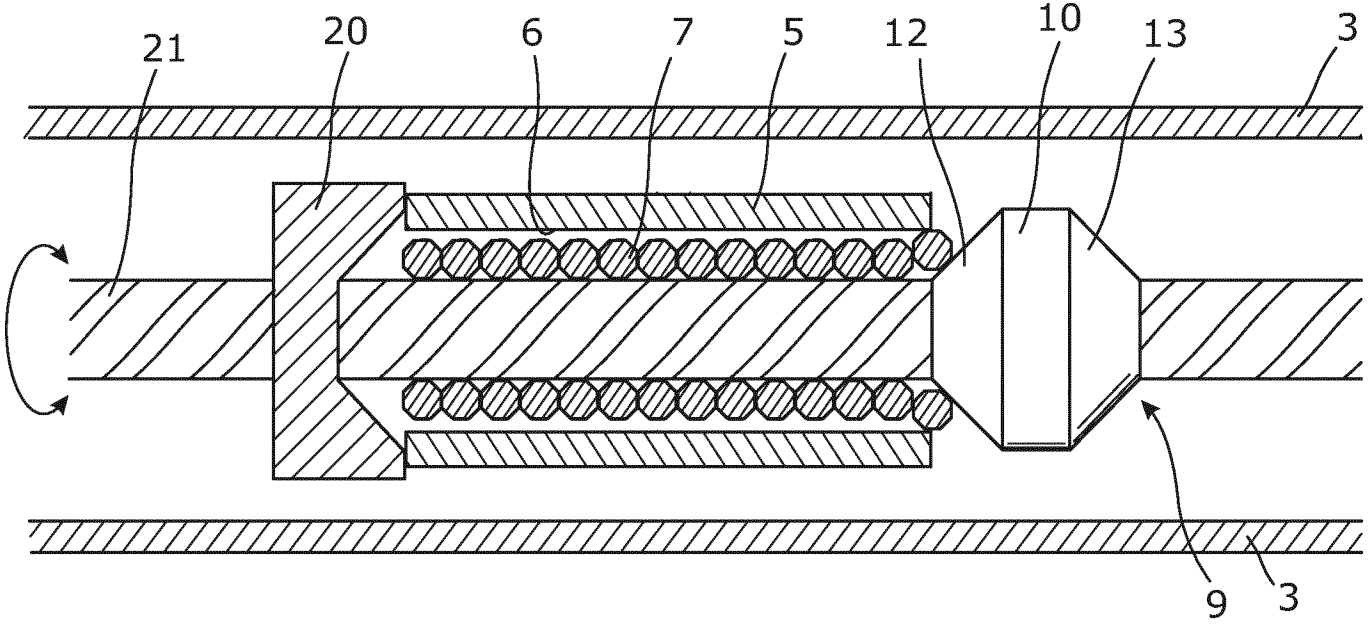
FIG. 8 is a cross-sectional view of yet another downhole system before expansion.
Figure 9:
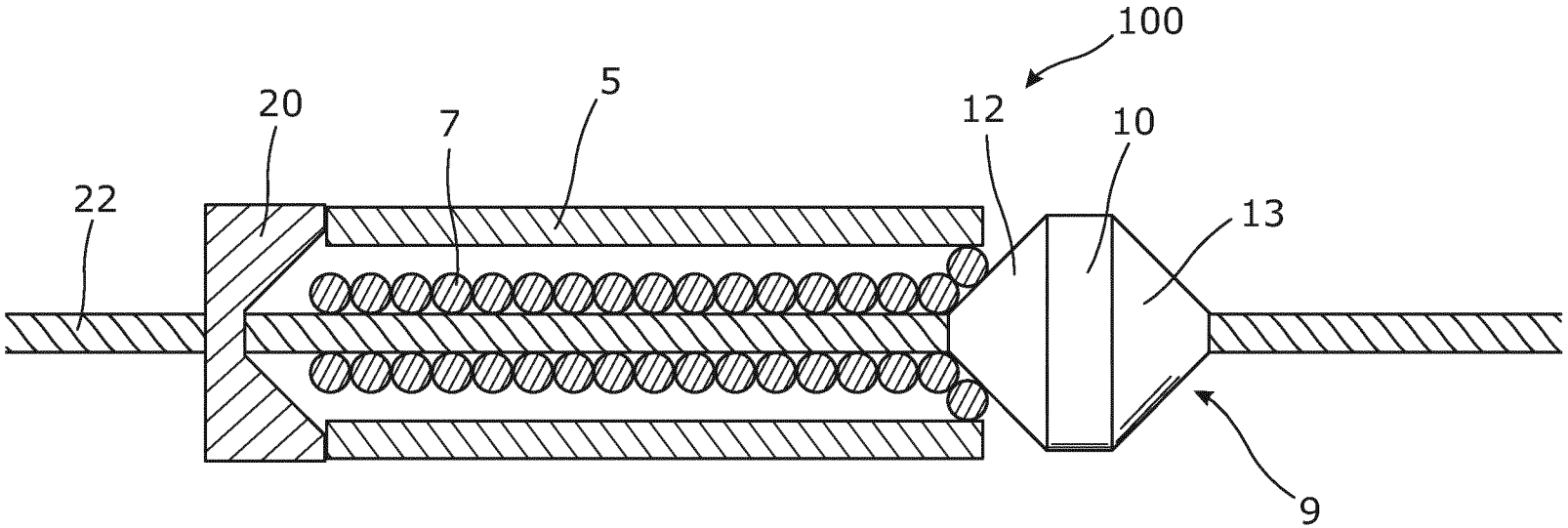
FIG. 9 is a cross-sectional view of yet another downhole system before expansion.

In FIG. 8, the shaft is replaced by a threaded rod 21 and in FIG. 9 by a wire 22. In FIG. 8, the threaded rod 21 allows for movement of the expansion part 10 by a rotational movement of the rod 21. In FIG. 9, a wire 22 enables the movement of the expansion part 10 by translatory movement of the wire 22. Furthermore, in FIG. 9 the downhole system 100 is shown without the well tubular structure.

To ensure that the whole length of the expandable tubular part 5 is expanded, the helical spring 7 is at least as long as the expandable tubular part 5 when the helical spring 7 is in a compressed state, i.e. when the windings of the spring are forced against each other, e.g. during expansion.

Furthermore, FIG. 7 shows an outer surface 15 of the expansion part 10 having a length which is at least as long as a width of two windings of the helical spring 7. It is hereby ensured that the helical spring 7 comes into contact with all of the inner face 6 of the expandable tubular part 5 and that the expandable tubular part 5 tightly abuts the well tubular structure 3 without any gaps between the expandable tubular part 5 and the well tubular structure 3. The outer surface 15 may be parallel to the well tubular structure 3, and/or the outer surface 15 may have an incline towards the well tubular structure 3 in order for the expansion part 10 to expand the expandable tubular part 5 a little further than obtained by the tapered part 12.

As shown in FIGS. 5-10, the helical spring 7 is, in the longitudinal direction, compressed against the expansion part 10 by arranging the back stop 20 at the second end 52 of the expandable tubular part 5. The back stop 20 counteracts the movement of the helical spring 7 in the same direction as the expansion part 10 when moving the expansion part 10 from the first position P1 to the second position P2.

In FIGS. 6-10, the expansion tool 9 comprises a second tapered part 13 with a suitable decline comparable to the incline of the tapered part 12, so that the helical spring 7 does not get stuck behind the expansion part 10 after expansion.

Figure 10:
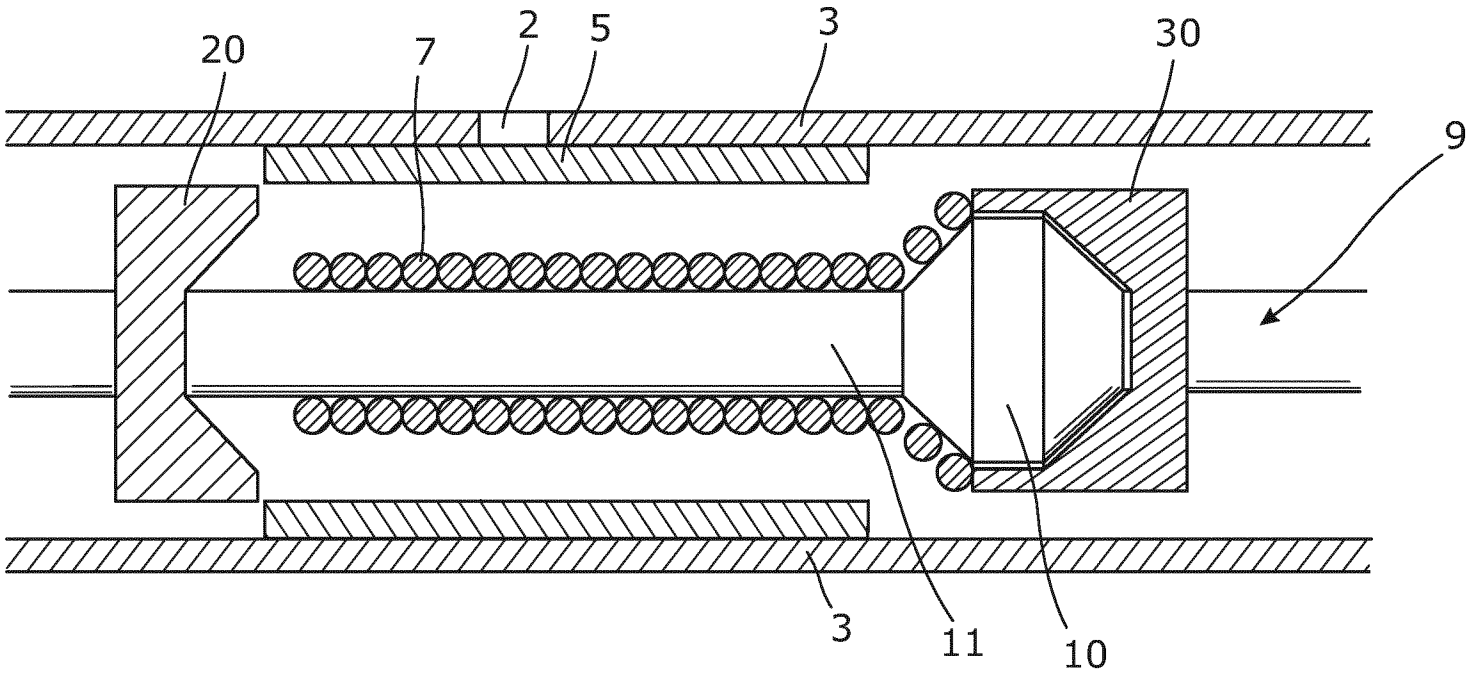
FIG. 10 is a cross-sectional view of yet another downhole system after expansion.

In FIG. 10, a helical spring retraction part 30 is arranged on the shaft 11 after the expansion part 10 in a longitudinal direction of the expansion tool 9. By having the helical spring retraction part 30, it is possible to ensure that the helical spring 7 may revert to an initial position on the shaft 11 so that the helical spring 7 may be used to expand additional expandable tubular parts.

It may be required, when repeating the procedure of expanding a second expandable tubular part 5, to force the helical spring 7 back into its initial position by means of the helical spring retraction part 30, such as shown in FIG. 10, if the helical spring 7 is not attached.

The expansion tool 9 may alternatively comprise an expandable expansion part 10, such as a radially expandable cone or an elastomeric or rubber element, which may be squeezed on either side of the elastomeric or rubber element, thereby expanding in the radial direction.

By a well tubular structure is meant any kind of casing, pipe, tubing, tubular, liner, string etc. used downhole in relation to oil or natural gas production.

In the event that the tools are not submergible all the way into the well tubular structure, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole system for sealing an opening in a wall of a well tubular structure in a borehole downhole by means of a downhole tubular assembly, comprising:

the downhole tubular assembly comprising:

an expandable tubular part having an inner face and an unexpanded expandable tubular thickness in an unexpanded state;

an expansion tool for expanding the tubular assembly inside the well tubular structure in one direction, the expansion tool comprising:

an expansion part having a diameter, and the expansion tool being arranged substantially on an axis which is concentric and longitudinal with the tubular assembly, and positioned in a first position, and wherein the expansion tool further comprises:

a helical spring arranged concentrically around the axis of the expansion tool, the helical spring having a helical inner diameter, a radial helical spring thickness and a helical outer diameter in an unexpanded state, the helical spring being arranged inside the expandable tubular part and substantially concentric with the expandable tubular part, and wherein the expandable tubular part is expanded by moving the expansion tool from the first position through the expandable tubular part and the helical spring so that the helical spring extends the diameter of the expansion part and acts as a distance element when expanding the expandable tubular part to abut the well tubular structure for sealing the opening.

2. A downhole system according to claim 1, wherein the expansion tool comprises a shaft connected with a tapered part of the expansion part.

3. A downhole system according to claim 2, wherein the tubular assembly is arranged between the expansion part and a back stop arranged on the shaft, the back stop having a recess corresponding to that of the tapered part of the expansion part so as to receive the expansion part.

4. A downhole system according to claim 1, wherein the helical spring is attached, in one end, to the expansion tool.

5. A downhole system according to claim 1, wherein the expansion tool further comprises a helical spring retraction part the helical spring retraction part being slidable in relation to the expansion part to move the helical spring in a direction opposite the direction of the expansion, thereby causing the helical spring to revert to the initial position on the shaft.

6. A downhole system according to claim 1, wherein the well tubular structure has an outer diameter which is substantially unchanged after expansion of the tubular assembly.

7. A downhole system according to claim 1, wherein the helical spring comprises a surface layer that provides low friction when slid against a surface of an inner wall of the expandable tubular part, a surface of the expansion part, and when slid against the surface of the helical spring itself.

8. A downhole system according claim 1, wherein the tubular assembly comprises a plurality of helical springs, and wherein the helical springs are arranged inside the expandable tubular part and substantially concentrically with the expandable tubular part, allowing for expansion of the expandable tubular part to abut the well tubular structure.

9. A downhole system according to claim 1, wherein the inner face of the expandable tubular part is in contact with the helical spring in an unexpanded state.

10. A method for sealing an opening in a wall of a well tubular structure in a borehole downhole, comprising the steps of:

determining a position in order to seal the opening, cover a leakage or a perforated zone or strengthen the wall of the well tubular structure, arranging a downhole system according to claim 9 opposite the position for setting an expandable tubular part of the tubular assembly, expanding the tubular assembly until the expandable tubular part abuts the inner surface of the well tubular structure by moving an expansion tool of the downhole system through the inside of the tubular assembly, unwinding the helical spring, and letting the helical spring return, at least partly, to a relaxed condition of the helical spring, thereby removing the helical spring from the expandable tubular part when the expandable tubular part has been expanded in its entire length and seals off the opening.

11. A method for sealing a plurality of openings according to claim 10, further comprising the step of moving the helical spring out of contact with the expansion part of the expansion tool by means of the helical spring retraction part.

12. A method for sealing a plurality of openings according to claim 10, further comprising the step of arranging a second expandable tubular part around the helical spring, thereby reusing the helical spring.

13. A downhole system according to claim 1, wherein the inner face of the expandable tubular part is out of contact with the helical spring in an unexpanded state.

14. A downhole system according to claim 1, wherein the helical spring is wound of a strand having a circular cross-sectional shape, a quadratic cross-sectional shape or an octagonal cross-sectional shape.

15. A downhole system according to claim 1, wherein the helical spring is wound of a strand having rounded corners in cross-section.

16. A downhole system according to claim 1, wherein the helical spring is made of a material having a higher yield strength than that of the expandable tubular part and/or of materials with good spring effect or non-adhesive effects on the expandable tubular part.

17. A downhole system according to claim 1, wherein the helical spring is made of metal, such as carbon steels, alloy steels, corrosion resisting steels, phosphor bronze, spring brass, beryllium copper, nickel alloy steels, titanium alloy steels, music wire, non-ferrous alloy wire, high temperature alloy wire, or any combination thereof.

18. A downhole system according to claim 1, wherein the helical spring comprises a surface layer that provides low friction when slid against a surface of the inner wall of the expandable tubular part, a surface of the expansion part of the downhole system, and when slid against the surface of the helical spring itself.

19. A downhole system according to claim 18, wherein the surface layer comprises a carbon-containing steel, a Teflon coating layer, an Aluminium magnesium boride layer (BAM), a titanium layer, a stainless steel layer or a steel layer.

20. A downhole system according to claim 1, wherein the tubular assembly comprises a plurality of helical springs, and wherein the helical springs are arranged inside the expandable tubular part and substantially concentrically with the expandable tubular part, allowing for expansion of the expandable tubular part to abut the well tubular structure.

* * * * *